US007252200B1

(12) United States Patent
Hester

(10) Patent No.: US 7,252,200 B1
(45) Date of Patent: Aug. 7, 2007

(54) DISPLAY ASSEMBLY

(76) Inventor: Thomas F. Hester, 3974 Pacific Coast Hwy., Ventura, CA (US) 93001

( * ) Notice: Subject to any disclaimer, the term of this patent is extended or adjusted under 35 U.S.C. 154(b) by 207 days.

(21) Appl. No.: 10/837,538

(22) Filed: Apr. 29, 2004

Related U.S. Application Data

(60) Provisional application No. 60/466,984, filed on Apr. 30, 2003.

(51) Int. Cl.
*A47G 29/00* (2006.01)

(52) U.S. Cl. ..... 211/72; 211/187; 211/126.16

(58) Field of Classification Search ..... 211/72, 211/73, 187, 70.1, 135, 175, 207, 189, 186, 211/149, 126.16; 206/45.27, 45.25, 736
See application file for complete search history.

(56) References Cited

U.S. PATENT DOCUMENTS

| | | | | |
|---|---|---|---|---|
| 1,852,471 | A | 4/1932 | Nelson | |
| 2,049,231 | A | 7/1936 | Storch | 211/135 |
| 2,373,778 | A | 4/1945 | Quinby | 40/125 |
| 2,824,395 | A | 2/1958 | Decker et al. | 40/125 |
| 3,113,392 | A | 12/1963 | Downing | 40/125 |
| 3,559,814 | A | 2/1971 | Downing | 211/135 |
| 3,601,916 | A | 8/1971 | Epstein | 40/125 |
| 3,987,737 | A | 10/1976 | Smith | 108/111 |
| 4,068,398 | A | 1/1978 | Parisi | 40/607 |
| 4,319,688 | A | 3/1982 | Wahl | 211/175 |
| 4,373,449 | A * | 2/1983 | Klaus et al. | 108/60 |
| 4,428,136 | A | 1/1984 | Franklin | 40/605 |
| 4,655,352 | A | 4/1987 | Noyes et al. | 211/175 |
| 5,443,168 | A * | 8/1995 | Dyment et al. | 211/149 |
| 5,483,779 | A | 1/1996 | Crawford et al. | 52/645 |
| 5,632,390 | A | 5/1997 | Podergois | 211/195 |
| 6,068,140 | A * | 5/2000 | Mangrum et al. | 211/132.1 |
| 6,267,255 | B1 * | 7/2001 | Brush | 211/59.4 |
| 6,378,710 | B1 * | 4/2002 | Grueneberg | 211/132.1 |
| 6,758,352 | B2 * | 7/2004 | Gervasi | 211/149 |

* cited by examiner

*Primary Examiner*—Jennifer E. Novosad
(74) *Attorney, Agent, or Firm*—Keisling Pieper & Scott PLC; David B. Pieper; Trent C. Keisling

(57) ABSTRACT

A display assembly apparatus and method of assembly using a folded frame and structurally reinforcing shelf for shipping and displaying products. The display uses a planar sheet for compact shipping which is adapted to be folded into the form of a vertically rising cabinet having a vertical supporting member defining shelf apertures which correspond to extending tabs on a shipping tray that allows for product to be shipped in the tray and then directly installed into the cabinet without the problems normally associated with stock transfer from shipping cartons to display areas.

1 Claim, 5 Drawing Sheets

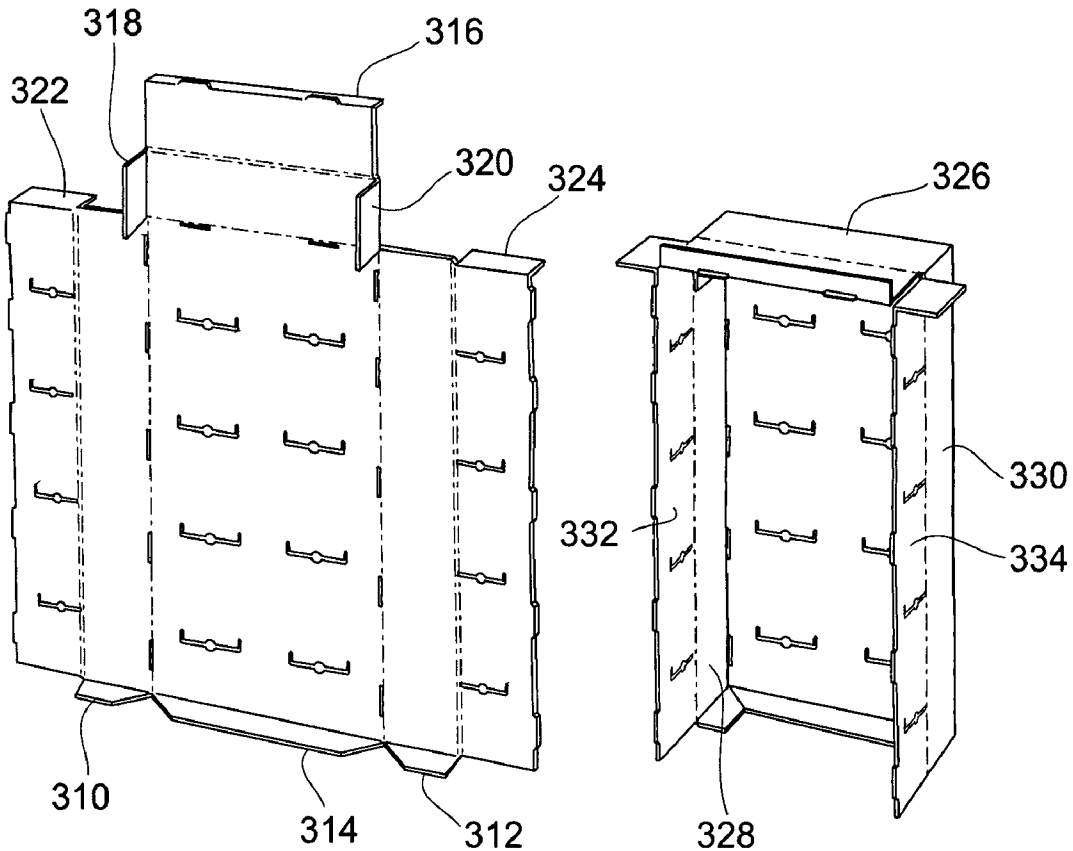
FIG. 5
FIG. 4
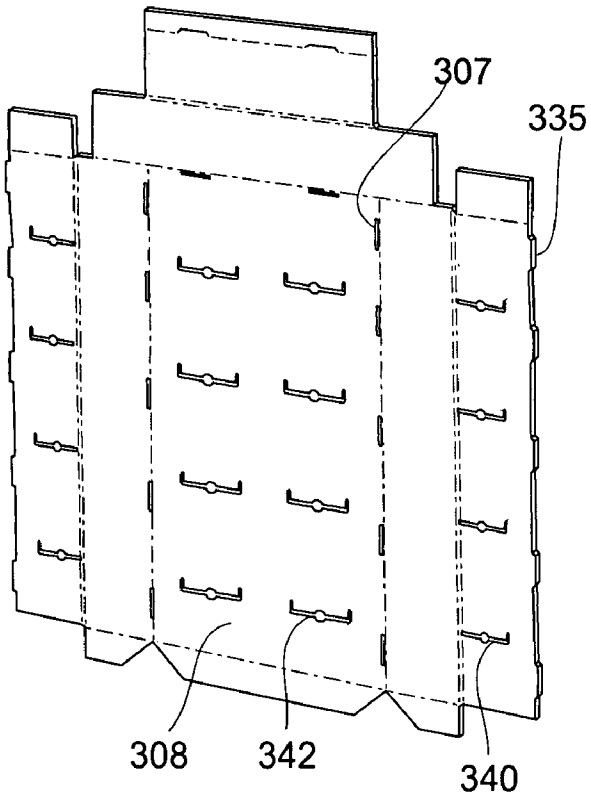
FIG. 3

DISPLAY ASSEMBLY

CROSS-REFERENCE TO RELATED APPLICATIONS

This application hereby claims priority to and is a continuation-in-part of U.S. provisional application Ser. No. 60/466,984, filed on Apr. 30, 2003 which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of display systems in general. In particular, the present invention relates specifically to a folded panel and tray display system.

2. Description of the Known Art

As will be appreciated by those skilled in the art, a folded corrugated cardboard display may be used to provide a display base for products in a retail or display environment. Details of a typical cardboard display are contained in U.S. Pat. No. U.S. Pat. No. 5,632,390, issued to Podergois on May 27, 1997; U.S. Pat. No. 5,483,779, issued to Crawford, et al. on Jan. 16, 1996; U.S. Pat. No. 4,655,352, issued to Noyes, et al. on Apr. 7, 1987; U.S. Pat. No. 4,428,136, issued to Franklin on Jan. 31, 1984; U.S. Pat. No. 4,319,688, issued to Wahl on Mar. 16, 1982; U.S. Pat. No. 4,068,398 issued to Parisi on Jan. 17, 1978; U.S. Pat. No. 3,987,737 issued to Smith on Oct. 26, 1976; U.S. Pat. No. 3,601,916 issued to Epstein on Aug. 31, 1971; U.S. Pat. No. 3,559,814 issued to Downing on February, 1971; U.S. Pat. No. 3,113,392 issued to Downing on December, 1963; U.S. Pat. No. 2,824,395 issued to Decker et al. on February, 1958; U.S. Pat. No. 2,373,778 issued to Quinby on April, 1945; U.S. Pat. No. 2,049,231 issued to Storch on July, 1936; and U.S. Pat. No. 1,852,471 issued to Nelson on April, 1932. Each of these patents is hereby expressly incorporated by reference in their entirety.

These prior art patents are very limited in their teaching and utilization, and an improved display assembly is needed to overcome these limitations. What is needed then is a combined folded frame and structural shelving display assembly.

SUMMARY OF THE INVENTION

The present invention is directed to improved display assemblies. In accordance with one exemplary embodiment of the present invention, a display assembly is provided for using a folded frame and structural shelf construction. The folded frame is made from corrugated paper and the shelving trays are manufactured from a thin walled plastic. Advantages of the present invention include: a compact shipping configuration; a lightweight shipping configuration; efficient use of materials; easy set up for the display without requiring tools; efficient display assembly; easy restocking of the display; easy change out of display graphics for different products; inexpensive materials for low cost impact on actual product marketing costs; and a structurally sound display for use in retail and other environments.

It is an object of the present invention to provide an aesthetic display system.

A further object of the present invention is to provide an inexpensive display assembly.

A still further object of the present invention is directed to provide a display assembly that provides for an efficient assembly without requiring tools.

Yet another object of the present invention is to provide a display assembly that is structurally sound without requiring adhesives or additional fasteners or connectors.

A still further object of the present invention is to provide a lightweight compact display assembly.

Yet a further object of the present invention is to provide free standing display assembly.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views:

FIG. 3 is an isometric view of an unfolded panel used to assemble the embodiment of FIG. 1.

FIG. 4 is an isometric view of an unfolded panel showing some of the folds used to assemble the embodiment of FIG. 1.

FIG. 5 is an isometric view of an unfolded panel showing additional folds used to assemble the embodiment of FIG. 1.

DETAILED DESCRIPTION OF THE INVENTION

Figure 2:
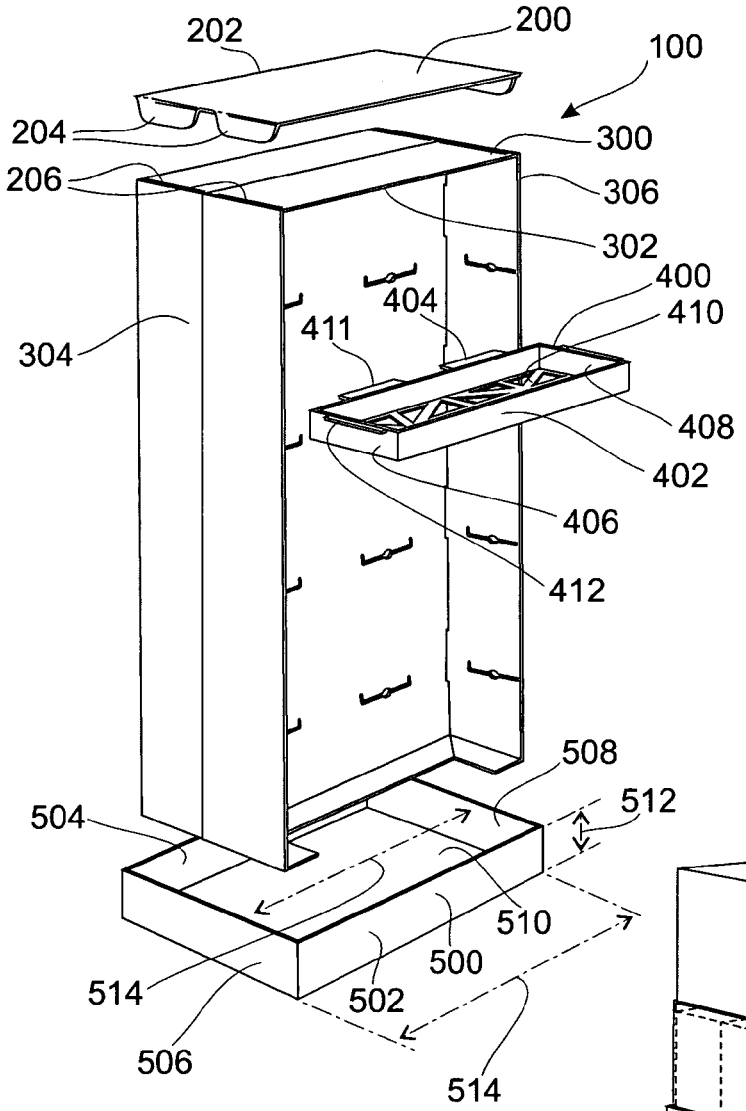
FIG. 2 is an exploded view of the embodiment of FIG. 1.
Figure 1:
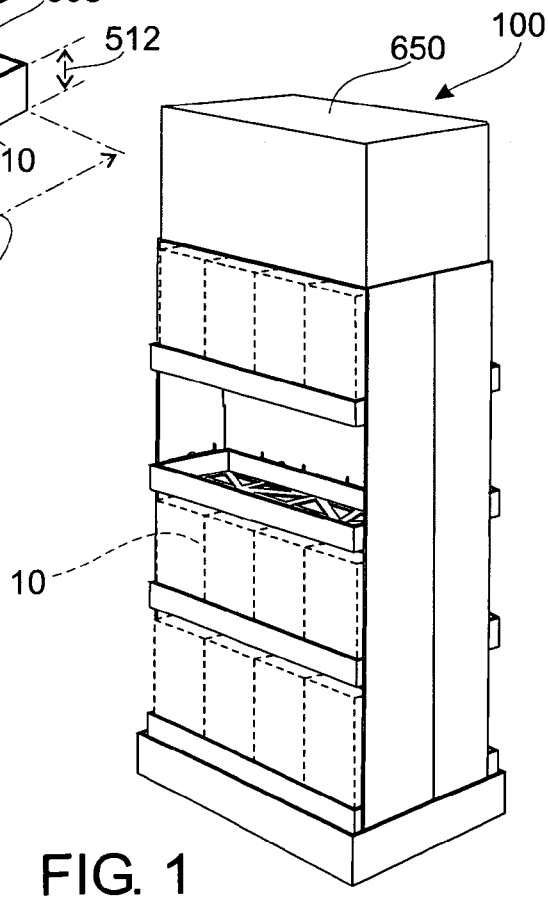
FIG. 1 is an isometric view of a first exemplary embodiment of the present invention.
Figure 11:
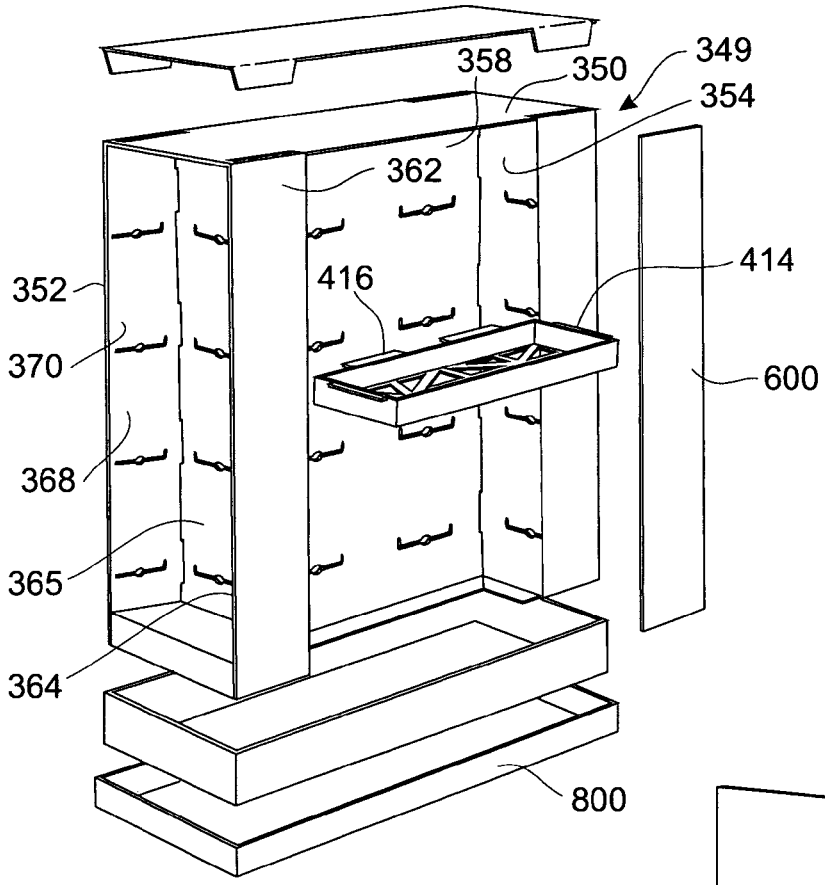
FIG. 11 is an exploded view of the embodiment of FIG. 10.
Figure 10:
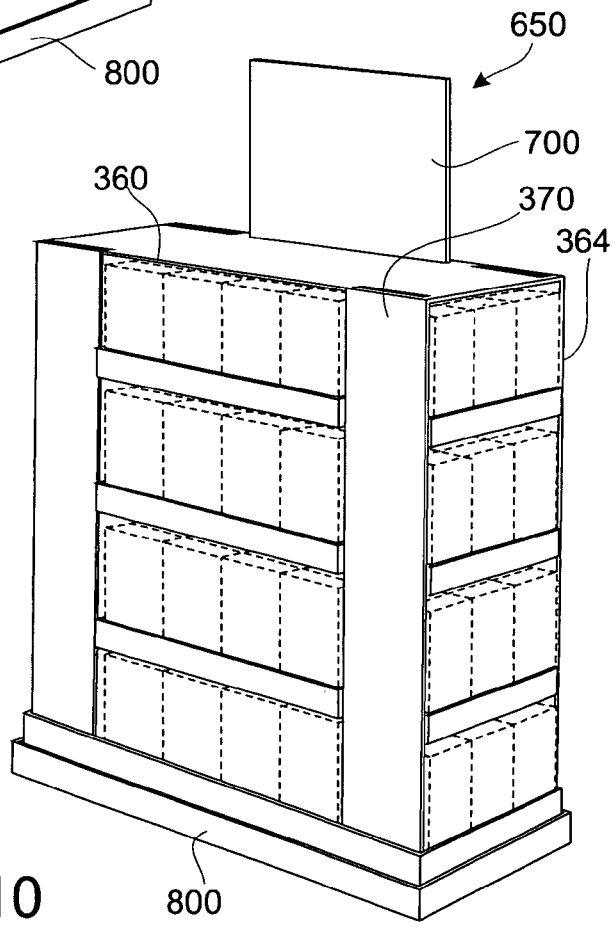
FIG. 10 is an isometric view of a second exemplary embodiment of the present invention.
Figure 13:
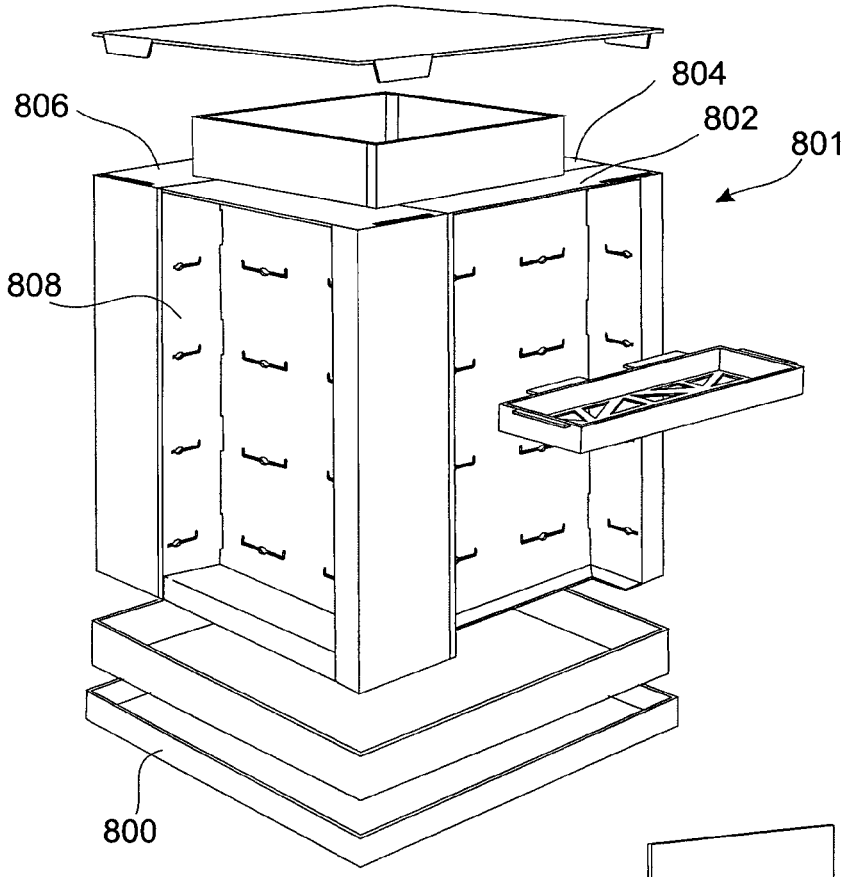
FIG. 13 is an exploded view of the embodiment of FIG. 12.
Figure 12:
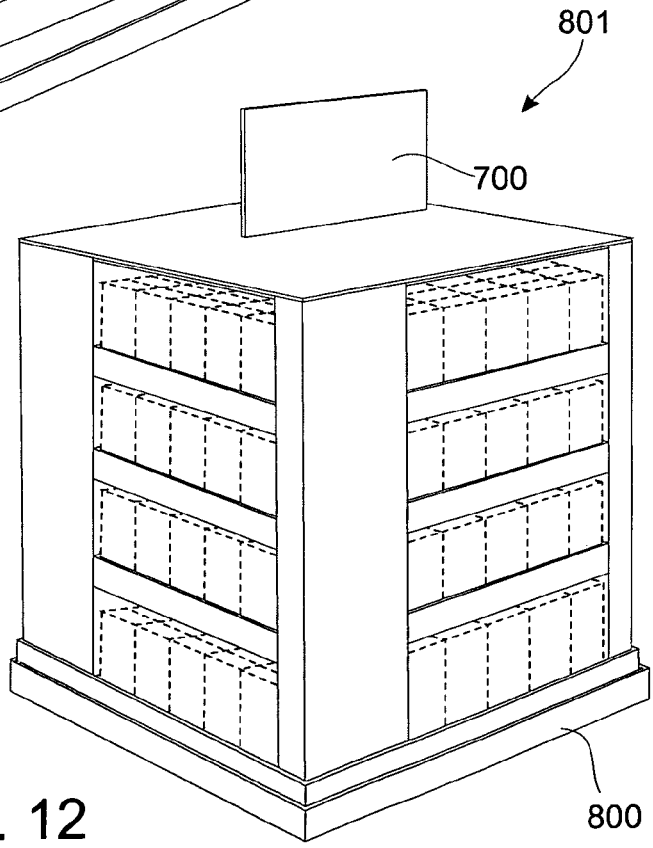
FIG. 12 is an isometric view of a third exemplary embodiment of the present invention.

FIGS. 1, 10, and 12 of the drawings show completed versions of various forms of the display assemblies 100, 349, 801 with graphics on the outer walls of the display assembly 100, 349, 801 for showing products 10. FIGS. 2, 11, and 13 show an exploded view of the various display assemblies 100, 100, 349, 801 showing the components of a display top 200, a display shelf support cabinet 300, a display shelf tray 400, and a display base 500.

As shown in FIG. 1 of the drawings, one exemplary embodiment of the present invention is generally shown as a front and back display assembly 100 with a display hat 650. FIG. 2 shows an exploded view of the front and back display assembly 100 showing the components of a display top 200, a vertically rising display shelf support cabinet 300, a display shelf tray 400, and a display base 500.

As shown in FIG. 2, the display top 200 is a planar sheet 202 having locking tabs 204 at each of the corners. The locking tabs 204 are adapted to fit into a top tab slot 206 formed by the cabinet sides 304, 306 of the display cabinet 300. This engagement allows the display top 200 to hold multiple display cabinets 300 together as is illustrated in FIG. 1.

FIGS. 1 and 2 show a vertically rising display shelf support cabinet 300 in its assembled form. FIGS. 3 through 9 show the folding assembly of the cabinet 300 from the initial planar sheet 202. The folded cabinet 300 includes cabinet top 302, left cabinet side 304, right cabinet side 306, cabinet back 308 and cabinet bottom 309.

FIG. 3 shows the unfolded form of the corrugated cardboard planar sheet 202 used for the cabinet 300.

As shown in FIG. 4, the bottom bracing panels 309 shown as the left side foot 310, right side foot 312, and back foot 314 are folded in. These will form the bottom bracing panels 309 that are angled in a perpendicular arrangement to provide support. Next, the top lip 316 is folded back and the left top support 318 and right top support 320 are folded in. Finally, the left side top tab 322 and the right side top tab 324 are also folded back.

FIG. 5 shows how the top external panel 326 and both the left side external panel 328 and right side external panel 330 are folded in.

Figure 6:
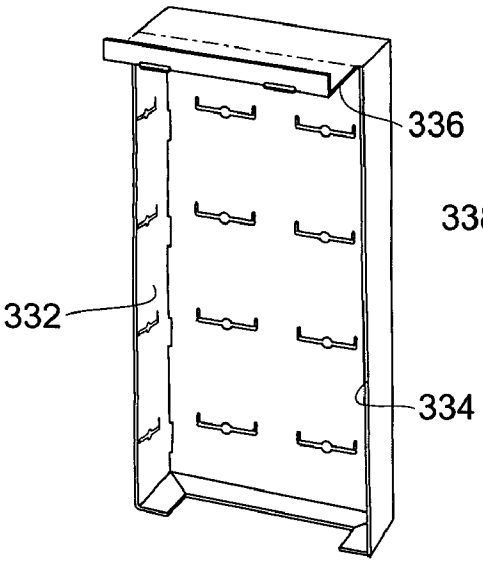
FIG. 6 is an isometric view of an unfolded panel showing still further folds used to assemble the embodiment of FIG. 1.

FIG. 6 shows the folding of the left side internal panel 332 and right side internal panel 334 in towards the internal side of the back 308 of the cabinet 300. The side internal panels 332, 334 fold over the left top support 318 and right top support 320 to hold the top external panel 326 in position. The side locking protrusions 335 are positioned to correspond with the protrusion slots 307 on the back 308 to hold the internal side panels in their final position.

Figure 7:
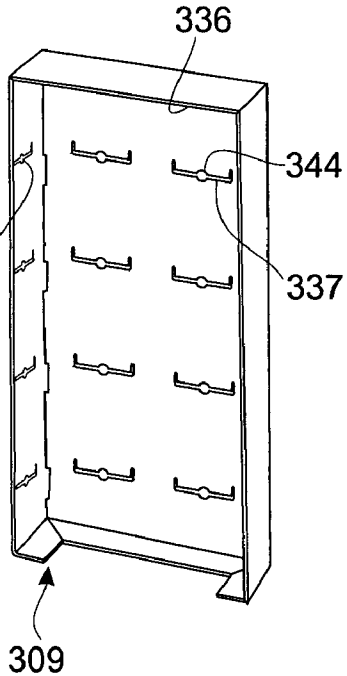
FIG. 7 is an isometric view of an unfolded panel showing yet another fold used to assemble the embodiment of FIG. 1.

FIG. 7 then shows the folding in of the top internal panel 336 over the left side top tab 322 and the right side top tab 324 to lock the sides in position. Top internal panel 336 also has protrusions which fit into protrusion slots 307 on the back 308 to hold the top internal panel 336 in its final position. The top lip 316 sits against the back panel 308.

Figure 8:
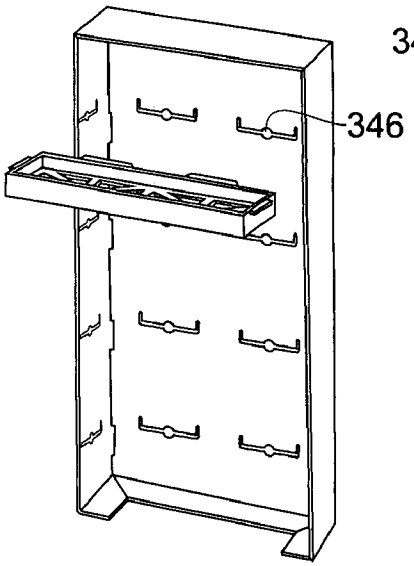
FIG. 8 is an isometric view of the initial insertion of a tray into a folded panel used to assemble the embodiment of FIG. 1.

FIG. 8 shows the use of the shelf apertures 337 shown as the left locking slot 338, the right locking slot 340, and the back locking slots 342 for accepting the shelf extension tabs 411 so that the apertures provide a place for supporting the tray 400. Also shown in FIG. 8 is the positioning of the tab flaps 344 that are flexibly connected to the vertical supporting members 303 above the shelf apertures 337, the tab flaps 344 adapted to move between a first access position 346 so that the extending tray tabs 411 can be inserted into the apertures 337. The tab flaps 344 may then be returned to their planar position such that they achieve a second locking position 348 to lock the extending tray tabs 411 in the apertures 337.

Figure 9:
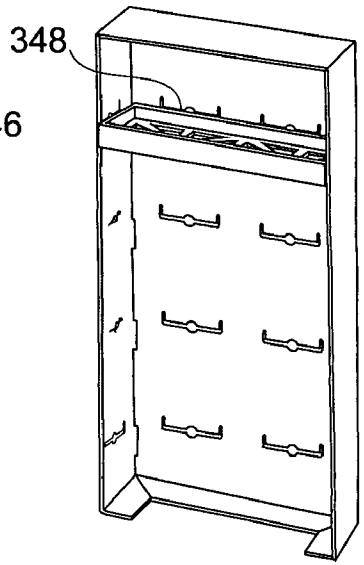
FIG. 9 is an isometric view of the final insertion of a tray into a folded panel used to assemble the embodiment of FIG. 1.

FIG. 9 shows the secondary motion for insertion of the tray 400 for the engagement of the tabs 411 shown as left, right, and back tabs 412, 414, 416 into the apertures 337 shown as left, right, and back slots 338, 340, 342.

FIGS. 2, 8, 11, and 13 show the display shelf tray 400 in a disengaged state. The tray is manufactured from an injected plastic and is used to package the product 10 during shipping. In this manner, the product 10 does not have to be removed from its shipping container to be inserted into the vertical display cabinet. This results in a great cost savings for installation of newly released product 10. Also, this simplifies restocking of empty shelves due to the simple removal of an empty shelf and the easy installation of full shelf as it was originally shipped. The tray 400 includes a front tray wall 402, a back tray wall 404, a left tray wall 406, a right tray wall 408, and a tray bottom 410. The tray bottom is shown with a grid design to reduce material and save weight for the tray. The tray further includes a left locking tab 412, right locking tab 414, and at least one back locking tab 416 for engaging the cabinet 300.

As shown in FIGS. 1, 2, 10, 11, 12, and 13 a display base 500 may be used to support the display cabinet 300. The display base 500 is formed in the same manner as a box top as is well known. The display base 500 has a front base wall 502, a back base wall 504, a left base wall 506, a right base wall 508, and a base bottom 510. The unique aspects of the display base are the base depth 512 and base width 514. The base depth 512 and base width 514 allow for the tray 400 to provide additional support to the base 500 of the display assembly 100 by using the bottom 410 of the tray 400 between the front base wall 502 and the cabinet back 308 and between the left base wall 506, left cabinet side 304 and the right base wall 508, right cabinet side 306 to wedge in the cabinet sides 304, 306 and back 308 within the base 500 and also lock in the feet 310, 312, 314 of the cabinet sides 304, 306 and back 308. Further improvements may be seen by the use of the base 500 to prevent toppling of the display assembly 100.

FIGS. 10, 11, 12, and 13 also show how supplemental graphic panels 600 may be utilized to change graphics for the display assembly 100. The graphic panels 600 are inserted into the base 500 and may be attached by a folded tab, adhesive, or a hook and loop type system. Also shown in these embodiments are the use of a display hat 650 which may be a box form or a simple vertical graphic panel 700 attached to extend upward from the top 200 of the display assembly. The use of a secondary base 800 may provide a baseboard or molding effect to the bottom of the display assembly 100.

FIGS. 10 and 11 show the construction of the front and side shipping display. As may be seen in the exploded view of FIG. 11, the same type of planar sheet construction may be used to that the planar sheet is folded into the form of a vertically rising cabinet. Here, the planar sheet defines a main cabinet 350, a second auxiliary cabinet 352, and a third auxiliary cabinet 352 from the same sheet. The planar sheet has been folded in order across the sheet to define a first main internal side panel 354, a main back 358, and a second main internal side panel 360, each of the auxiliary cabinets is similarly constructed with the second cabinet shown as a first auxiliary external side panel 362, a first auxiliary internal side panel 364, a first auxiliary back 366, a second auxiliary external side panel 368, and a second auxiliary internal side panel 370. The first main internal side panel 354, main back 358, second main internal side panel 360, first auxiliary internal side panel 362, auxiliary back 366, and second auxiliary internal side panel 370 define shelf apertures 337 for supporting the shipping tray. A top panel 200 is also used for support and an alternative construction for the display hat 650 is shown FIGS. 12 and 13 shows the construction of a multisided compacted shipping display. This embodiment uses four planar sheets where each planar sheet is folded like the first embodiment to form the four vertically rising cabinets 802, 804, 806, and 808. Each main cabinet is placed on the side of a square with the shelf area pointing outward to form the four sides of the display. The top panel uses multiple side tab support which fit between the internal and external side panels of the various cabinets to hold the top of the vertically rising cabinets in position and the display base contains the bottom or feet of the different vertical supporting members 303 to limit movement of the vertically rising cabinets. Also shown in the use of a central wedge to hold the cabinets against rising sides of the base so that the cabinets cannot be forced inward on the base.

Numbers used to reference items in the drawings are provided as follows:

Product, item 10
Shipping display 100
display top 200
planar sheet 202
locking side tab supports 204
top tab slot 206
vertically rising display shelf support cabinet 300
cabinet top panel 302
vertical supporting member 303
left cabinet side 304
right cabinet side 306
back slots 307
cabinet back panel 308
bottom bracing panel 309
left side foot 310
right side foot 312
back foot 314
top lip 316
left top support 318
right top support 320
left side top tab 322
right side top tab 324
top external panel 326
left side external panel 328
right side external panel 330
left side internal panel 332
right side internal panel 334
protrusion 335
top internal panel 336
Shelf aperture 337
left locking slot 338
right locking slot 340
back locking slots 342
tab flaps 344
a first access position 346
a second locking position 348
front and side display 349
a main cabinet 350
an auxiliary cabinet 352
a first main internal side panel 354
a first main external side panel 356
a main back 358
a second main internal side panel 360
a first auxiliary external side panel 362
a first auxiliary internal side panel 364
an auxiliary back 366
a second auxiliary external side panel 368
a second auxiliary internal side panel 370
shipping display shelf tray 400
front tray wall 402
back tray wall 404
left tray wall 406
right tray wall 408
tray bottom 410
tabs 411
left extending locking tab 412
right extending locking tab 414
back extending locking tab 416
display base 500
front base wall 502
back base wall 504
left base wall 506
right base wall 508
base bottom 510
base depth 512
base width 514
supplemental graphic panels 600
a display hat 650
vertical graphic panel 700
secondary base 800
four sided display 801
first vertically rising cabinet 802
second vertically rising cabinet 804
third vertically rising cabinet 806
fourth vertically rising cabinet 808

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. A compacted shipping display apparatus for shipping and displaying at least one item, the display apparatus comprising:

at least one planar sheet folded into the form of a vertically rising cabinet having at least two vertical supporting members each member defining at least one shelf aperture and each member defining at least one top tab aperture, the planar sheet further folded to define a top panel including multiple locking side tabs wherein each tab is positioned to interconnect with at least one of the top tab apertures; and a shipping tray including a tray bottom and at least one extending tray tab, the tray tab positioned on the shipping tray to correspond with the shelf apertures such that the shipping tray can be supported off of the vertical supporting member.

* * * * *